US007874903B2

(12) United States Patent
White et al.

(10) Patent No.: US 7,874,903 B2
(45) **Date of Patent: *Jan. 25, 2011**

(54) MODIFIED POKER WITH BONUS MATCH CARD

(75) Inventors: Warren R. White, Reno, NV (US); Loren T. Nelson, Reno, NV (US); Dimo D. Ditchev, Las Vegas, NV (US); Russ F. Marsden, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 1105 days.

This patent is subject to a terminal disclaimer.

(21) Appl. No.: 11/550,349

(22) Filed: Oct. 17, 2006

(65) Prior Publication Data

US 2007/0066378 A1 Mar. 22, 2007

Related U.S. Application Data

(63) Continuation of application No. 10/242,254, filed on Sep. 12, 2002, now Pat. No. 7,128,645, which is a continuation-in-part of application No. 09/912,797, filed on Jul. 23, 2001, now Pat. No. 6,749,500.

(51) Int. Cl.
*A63F 9/24* (2006.01)

(52) U.S. Cl. ..... 463/13; 463/16; 273/292; 273/274

(58) Field of Classification Search ..... 463/13; 273/292

See application file for complete search history.

(56) References Cited

U.S. PATENT DOCUMENTS 5,308,065 A * 5/1994 Bridgeman et al. ..... 463/13
5,489,101 A 2/1996 Moody
5,542,669 A * 8/1996 Charron et al. ..... 463/13
5,833,536 A * 11/1998 Davids et al. ..... 463/11
5,851,148 A 12/1998 Brune et al.
5,853,325 A 12/1998 Kadlic
5,882,259 A * 3/1999 Holmes et al. ..... 463/13
5,971,849 A 10/1999 Falciglia
6,062,981 A 5/2000 Luciano, Jr.
6,098,985 A 8/2000 Moody
6,110,040 A 8/2000 Sanduski et al.
6,131,907 A 10/2000 Nucifora et al.
6,132,311 A 10/2000 Williams
6,146,271 A 11/2000 Kadlic (Continued)

*Primary Examiner*—David L Lewis
*Assistant Examiner*—Chase Leichliter
(74) *Attorney, Agent, or Firm*—Steptoe & Johnson LLP

(57) ABSTRACT

A system and method for adding a bonus round to any poker-style card game on a Nevada-style gaming machine. The bonus round is characterized by the existence of a match card. The match card is not part of the traditional poker hand (the "in-hand" cards) of the player, and only comes into play during a bonus round. The suit and value of the match card may be generated by the game machine or a remote game controller or backend server. The match card is then displayed in a manner visually associating the match card with one of the player's "in-hand" cards. A bonus is determined by evaluating the associated pair. Alternatively a bonus may be determined first, in which case the game machine determines a match card and associated card from the player's in-hand cards that is the equivalent of the predetermined bonus.

10 Claims, 5 Drawing Sheets

U.S. PATENT DOCUMENTS 6,149,521 A 11/2000 Sanduski
6,227,969 B1 * 5/2001 Yoseloff ..... 463/13
6,257,979 B1 7/2001 Walker et al.
6,398,645 B1 6/2002 Yoseloff
6,443,456 B1 9/2002 Gajor
6,604,998 B1 8/2003 Singer et al.
2002/0034974 A1 * 3/2002 Wood et al. ..... 463/13
2002/0107063 A1 * 8/2002 Ashley et al. ..... 463/13

* cited by examiner

Game Device
For Match Card Poker Play

Game Device
For Match Card Poker
Play With Apparent Skill

Game Device
For Match Card Poker Play
With Another
Apparent Skill Display

Method For Match Card Bonus Poker Game

Method For Reverse Mapping Match Card Bonus

MODIFIED POKER WITH BONUS MATCH CARD

CROSS-REFERENCE TO RELATED APPLICATIONS

This application is a continuation of U.S. patent application Ser. No. 10/242,254 filed Sep. 12, 2002, now pending, which is a continuation-in-part of U.S. patent application Ser. No. 09/912,797 filed Jul. 23, 2001, now U.S. Pat. No. 6,749,500 issued Jun. 15, 2004, which are herein incorporated by reference in their entirety.

BACKGROUND OF THE INVENTION

1. Field of the Invention

This invention pertains generally to gaming systems. More particularly, the present invention relates to a method and apparatus for providing a bonus game in addition to the base poker game, where the bonus game is displayed as a bonus match card.

2. The Prior Art

Fixed pool games are well known, often forming the basis of many games used by many state and private lotteries. A fixed pool game is one in which a specified amount of money or prizes (the prizes having calculable monetary equivalents) are distributed into a set of individually purchasable and winnable units, where each individual unit has a known cost, and where the set further includes purchasable units having no prize. Thus, the total amount of prizes, the prize distribution (i.e., the number of prizes at each level), and the total return if all individually purchasable units are sold are known at the game's outset.

The individually purchasable units are typically generated and distributed as tickets. The two most common form of tickets are pull tab tickets, called pulltabs, and scratch-off tickets, called scratchers. Pull tab tickets are typically constructed from paper of various thickness, having two layers. The first layer has some type of indication of the purchasers' winnings, if any, and the second layer covers the first. The second layer is typically glued to the first layer around three edges, covering the results. The fourth edge typically has a small tab, allowing the purchaser to grab hold of it. The tab, upon being pulled, pulls the layers apart and reveals the purchasers' winnings, if any. Scratchers use an opaque material that covers portions of the ticket, where the covered portions have the predetermined results on them. The purchaser scrapes off the opaque material, revealing any winnings.

The distribution of the total winnings, coupled with the cost of each individually purchasable unit, is determined by those making up the game. The exact mechanics and mathematics of each game pool depends on the goals of the issuer, including the target play audience (how much to charge per purchasable unit or ticket or play), the desired return on investment, and size of the pool, as well as other considerations as are well known in the art. The tickets (individually purchasable units) for the entire game are then printed and distributed, usually organized into decks with different decks sold to different locations. Players, by purchasing a ticket, are buying one individually purchasable unit from the overall ticket or game event pool.

This is may be referred to as a fixed-pool lottery, meaning there is a fixed pool of tickets (or results) having a predetermined number of winners and losers, and a purchaser takes a chance on getting a winning result by entering the "lottery", meaning taking the chance they will by a winning ticket from the pool.

To make the results more interesting to a player, fixed-pool lottery based games have been recently been displayed in many ways. One particular representation is as a poker hand, attempting to mimic actual poker play.

The player bets a certain amount to play the game. This corresponds to an individually purchasable unit (note that different betting amounts may participate in different fixed-pool lotteries) for the lottery being used. The game will typically get the result of a random drawing from a central server or location having several operating pools. The result is sent back to the game machine. The game machine then represents the results in as a game.

Up to the present time, game machines using fixed-pool lotteries which have attempted to represent the predetermined winning amount by mimicking poker play have had significant limitations. In particular, the prior art machines would present the player with a 5 cards (mimicking a hand), and the player would indicate which cards to hold, where any not held are discarded. If the player is either not a good poker player or is going for long odds, if is likely they will discard cards that were needed to make up the predetermined winning hand.

For example, suppose the predetermined award required the player to end up with a full house and the player's initial hand had two pair. If the player discards one from pair, leaving three unrelated cards, a full house cannot be created with the new draw. The prior art game overrides the player's hold choices and discards the "correct" cards, resulting in a new hand having a full house.

The action of overriding a player's choices completely ruins the intended purpose of the game, which is to produced the illusion of true poker play. Thus, there is a need to have a game, based on the use of fixed-pool lotteries, that can better mimic true poker play from a player's perspective.

Further, it has been discovered that players using tradition Nevada-style poker machines, where game results are not predetermined but are based on a random result for each game, want the extra excitement of a bonus round that fits the poker theme of the game more closely than extraneous bonus style play (i.e., apparently unrelated screens having bonus amounts, or secondary games used for bonus plays that are not tightly coupled with the primary poker game).

BRIEF DESCRIPTION OF THE INVENTION

The present invention discloses a method and apparatus to allow an entertaining bonus play matching the poker game theme, using Nevada-style game determination results. After a player plays a hand of regular poker, a random event is used to generate a final card which is not part of the regular 5-card (or 3-card, or other number being played) poker hand. If the newly generated card matches a designated card from the player's final hand, the player wins a bonus.

The present invention uses a match card, from a player's viewpoint, in the same way as disclosed in application Ser. No. 09/912,797 entitled "Modified Poker for Use with Predetermined Outcomes", said application incorporated by reference in this application in full. However, the game of the present invention works differently than the game in application Ser. No. 09/912,797 in that the results are not based on a predetermined draw. Rather, the game uses randomly generated results to generate the cards in a player's hand, any replacement cards, and finally the match card (alternatively, a pre-defined bonus). This enables the game to be used in a Nevada-style gaming jurisdiction, whereas the game using predetermined results is usable in a jurisdiction requiring lottery-style pools. Both display and play similarly to a player, so a player can enjoy what appears to them as the same game (Match Card Poker) no matter which jurisdiction type they are in.

DETAILED DESCRIPTION OF THE PREFERRED EMBODIMENTS

Figure 1:
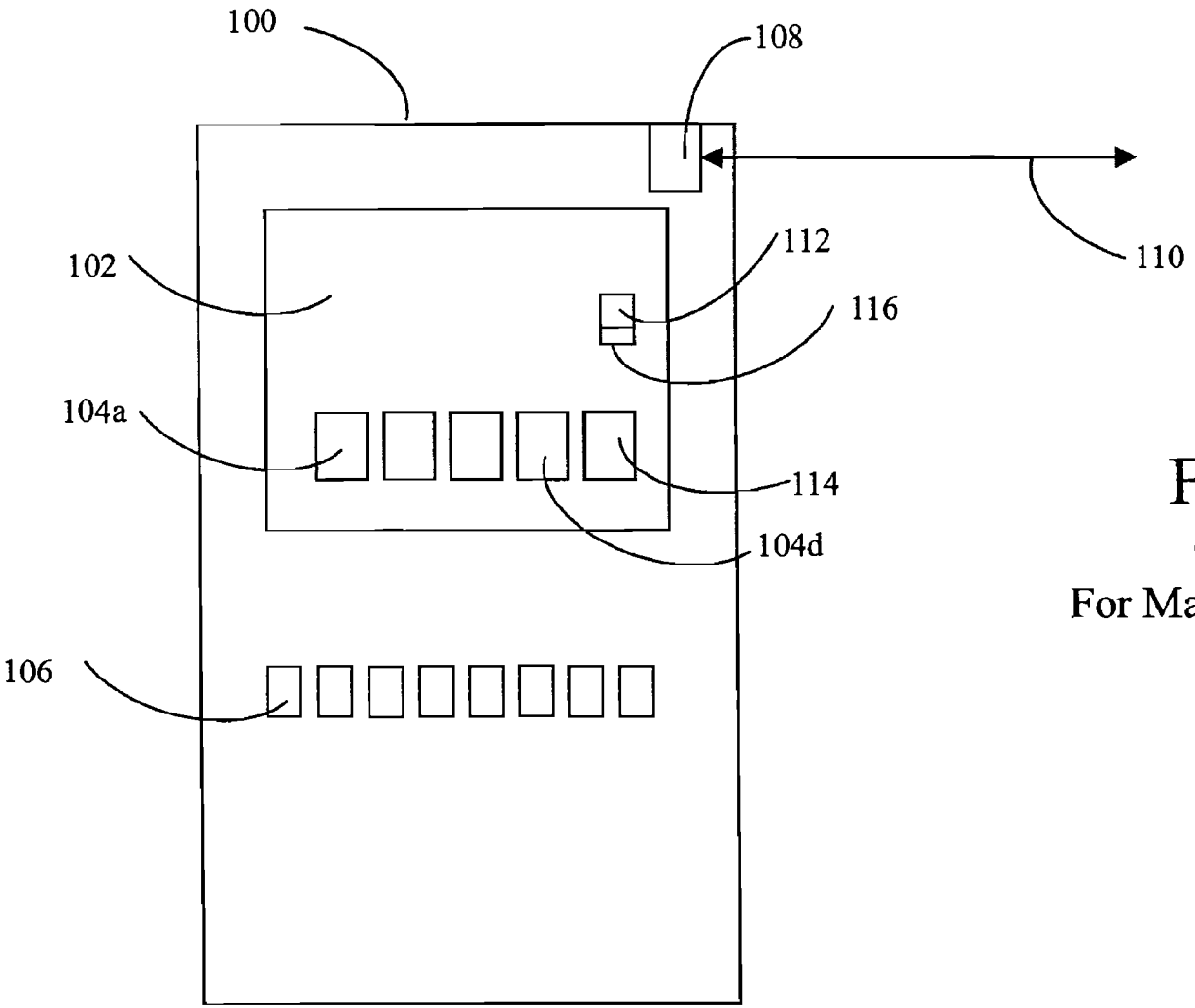
FIG. 1 is a functional block diagram of an example game device in accordance with the present invention.

Persons of ordinary skill in the art will realize that the following description of the present invention is illustrative only and not in any way limiting. Other embodiments of the invention will readily suggest themselves to such skilled persons having the benefit of this disclosure.

Referring to the drawings, for illustrative purposes the present invention is shown embodied in FIGS. 1 through 5. It will be appreciated that the apparatus may vary as to configuration and as to details of the parts, and that the method may vary as to details, partitioning, and the order of the acts, without departing from the inventive concepts disclosed herein.

FIG. 1 shows a game device according to the present invention. The game device has a cabinet 100 enclosing a video display 102 and a set of standard game play buttons shown generally as buttons 106. The game device also comprises the internal hardware and software needed for gaming devices, including at least one processor, dynamic memory, non-volatile memory, system support circuitry such that the operating system of choice will run properly, and I/O connections including interfaces to the various player interfaces such as play buttons 106 and video 102 output, and an interface to an external network connection shown as SMIB (slot machine interface board) 108. Also included is the software needed to implement the specific game. The internals are not illustrated. SMIB 108 interfaces with a network connection 110, typically to an RGC (remote game controller, not shown). Alternatively, 108 may be an ethernet connection to an ethernet-based backbone network 110.

In addition to many features that are typical to a game device and not illustrated such as various glass art, the new and unique addition to poker game play is shown. It was discovered that players respond very positively to a bonus play implemented using a specially designated card, shown as card 112, over and above the cards that comprise a traditional poker hand. The additional card will be referred to as a "match card" for the purposes of this disclosure, and "in-hand" refers to the cards that comprise a poker hand. The actual number of cards in-hand varies depending on the type of poker being played or used. Illustrated is five card draw poker, having five cards in-hand, shown as cards 104*a* through 104*d* and card 114.

Match card 112 is shown placed above one of the in-hand cards, card 114. In one embodiment, this physical placement corresponds to the card association that indicates which two cards must match if a bonus is to be won. Match card 112 is left illustrated on the video screen as a reverse side up card until the player is shown a hand, makes hold decisions, and the discarded cards replaced. Simultaneously with, or shortly after, the discards are shown as replaced with "new" cards, match card 112 is shown as turned onto its obverse. In this implementation, match card 112 and the card shown in position 114 must be the same card for a bonus event to occur (these two cards are termed "associated cards", indicated by their relative physical position on screen 102). If they show as the same card, a bonus is displayed in bonus window 116, which is added to the player's overall game credits, score, or may be awarded as a separate prize utilizing a voucher printer (printer not shown).

As used in this disclosure, "same card" is defined to mean that two cards have the same suit and value showing on their obverse sides. "Matched card", "matching card", and "match card" are used in this disclosure to mean two cards having the same suit, the same value, the same suit and value, or being two "related cards." "Related cards" is defined to mean two cards related by explicit rules of the game other than suit and face value. An example of "related cards" is a game where a bonus is awarded if the bonus card has twice the value of the inhand card, such as the bonus being a ten of diamonds and the in-hand card to which it is associated is a five of diamonds. Thus, examples of "matched cards" includes "same cards" such as both cards being a queen of diamond, same suit cards such as a two and a ten of clubs, same value cards such as a three of spades and a three of hearts, and any two cards related by the rules of a particular game. Each particular game implementation will make clear which cards match. In one preferred embodiment, the amount a player wins will depend on which match a player's match card makes: the highest bonus occurs with a suit and value match, next comes a value match, next a suit match, etc. The present invention works equally well with all types of match definitions, with ordered as to likelihood of occurrence.

In one preferred embodiment, match card 112 is implemented as an image (on a video screen) having a different size, physically, from the in-hand cards 104*a* through 104*d* and 114. This helps distinguish the two types of cards, visually, for the player. Match card 112 is intended to be visually suggestive of a random card drawn from a different deck than the in-hand cards, where bonus points are awarded if the "randomly drawn" match card 112 and the card in position 114 are the same card (suit and value).

A preferred embodiment using five card draw is shown in FIG. 1, however, the present invention is readily used in any of the numerous poker variations used in poker gaming machines, including but not limited to 5 and 7 card stud, Texas Hold'em, the various three-card and more in-hand card games found in some poker variations, and the any of the multi-line and multi-hand poker variations. The present invention is used by having each individual in-hand card set (perhaps represented by a demarcation line in a card matrix, for example, as well as the traditional line of cards) also be associated with a match card. Note that a single match card may be associated with more than one in-hand card set, although there must be at least one match card associated with each playable inhand set of cards.

Figure 2:
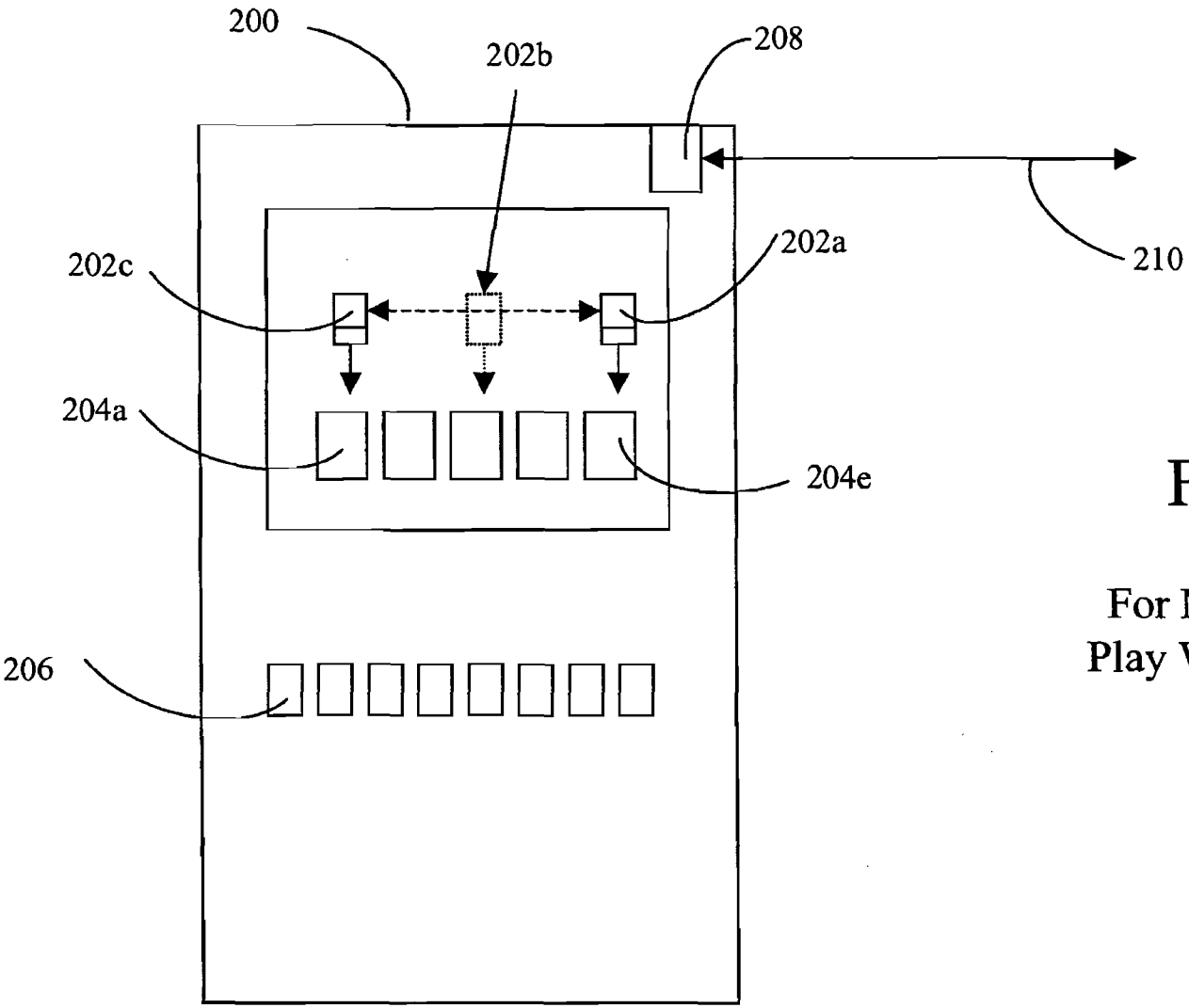
FIG. 2 is a functional block diagram of an example game device in accordance with the present invention including an apparent skill element.

Another variation is to make the link between a match card and the in-hand card be dynamic. Such a dynamic link may be implemented in many ways. One implementation is to have the match card appear to "travel" across the top of a screen, just above the in-hand card set. This shown illustrated in FIG. 2. FIG. 2 shows gaming machine 200 having the internals described for FIG. 1 (not shown), a 5-card hand having cards 204*a*-204*e*, player input buttons 206, a network connection 208 and network 210. Further shown is a match card in positions 202*a*, 202*b*, and 202*c*. Position 202*b* is shown as shaded to indicate movement between positions 202*a* and 202*c*, along the dotted arrow. The match card may be shown as moving steadily across the tops of the in-hand card sets, or alternatively "flashing" from location to another, finally stopping above the inhand card which must be a match for the player to get bonus points. Apparent skill may be added in many ways, one in particular being to have the moving or traveling show its obverse after a player has otherwise finished play of the standard game, but before the traveling match card stops moving. A "stop" button is available to the player (one the player input buttons generally designated as 206), its apparent function being to stop the moving match card in a preferred position (above a matching in-hand). The player hits the "stop" button in an attempt to have the moving card stop in a bonus position.

Figure 3:
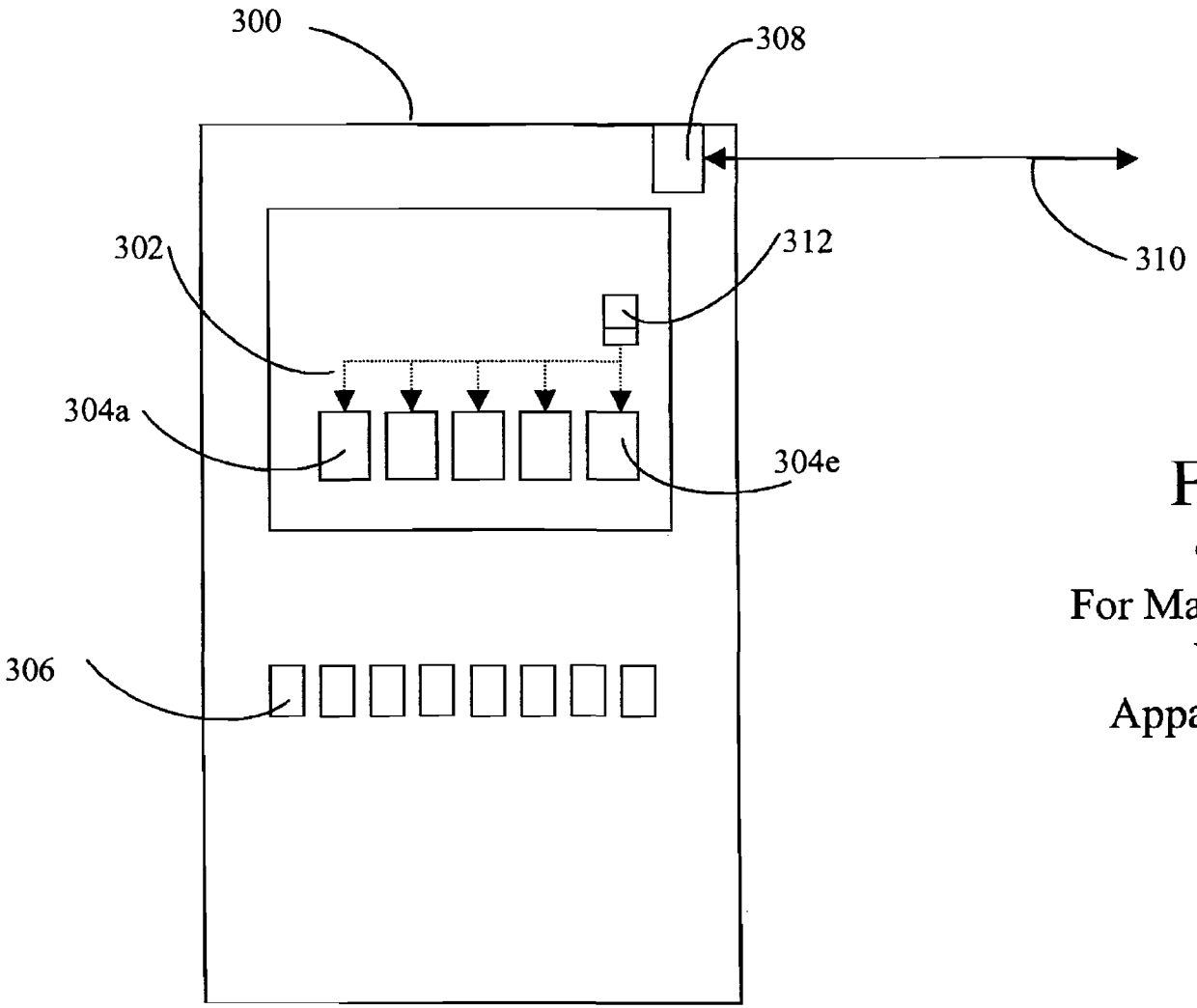
FIG. 3 is a functional block diagram of an example game device in accordance with the present invention including another apparent skill element.

Another dynamic link implementation would keep the match card stationary, but have the appearance of lines, dashes, lightening bolts, or other interesting forms represent the link. This is shown in FIG. 3. Game machine 300 has network connection 308 to network 310, player buttons 306, internals as described for FIG. 1 but not shown, player cards 304*a*-304*e*, match card 312, and links 302. To win, the dynamic link must end its movement (by not flashing or stopping any similar visual indication) such that the match card and its link point to, or indicate, a matching card from the player's hand. There will be a visible association between the match card and an in-hand card, the associated cards indicating a bonus if the cards match. The link is shown as dynamic; in the embodiment shown in FIG. 3 this would involve highlighting (using color and luminescent intensity) a path between match card 312 and each of cards 304*a* through 304*e* in sequence. The link them stops at the final match selection, and if the match card and in-hand match, the player wins a bonus. Like the traveling match card above, the dynamic can be implemented as an apparent skill game by having a "stop" button that has the apparent affect of being able to stop the moving or flashing link, allowing the player to attempt to have the link connecting a match card with a like-valued in-hand card.

A further dynamic link is to have a display where a match card and a set of in-hand cards have fixed relative locations, and where the "link" is shown by bright same-color borders around the match card and one of the in-hand cards, or by having the image of the two cards be brought up in intensity so they stand out from the others. This is a preferred embodiment where the player is playing multiple hands. Having lines connecting different cards may be too visually confusing with multiple card sets and multiple match cards all being displayed at once. With multiple displays, a corresponding match card and in-hand card could be visually separated from each other by using different colored borders for each pair, or having each pair show an intensified, color-cued and color-hued image. If the borders or other color-based highlights are made to appear to "move" down the line of in-hand cards, an apparent skill game may be implemented by allowing the player to hit a stop button when the currently highlighted card matches the match card with the same hue.

Figure 4:
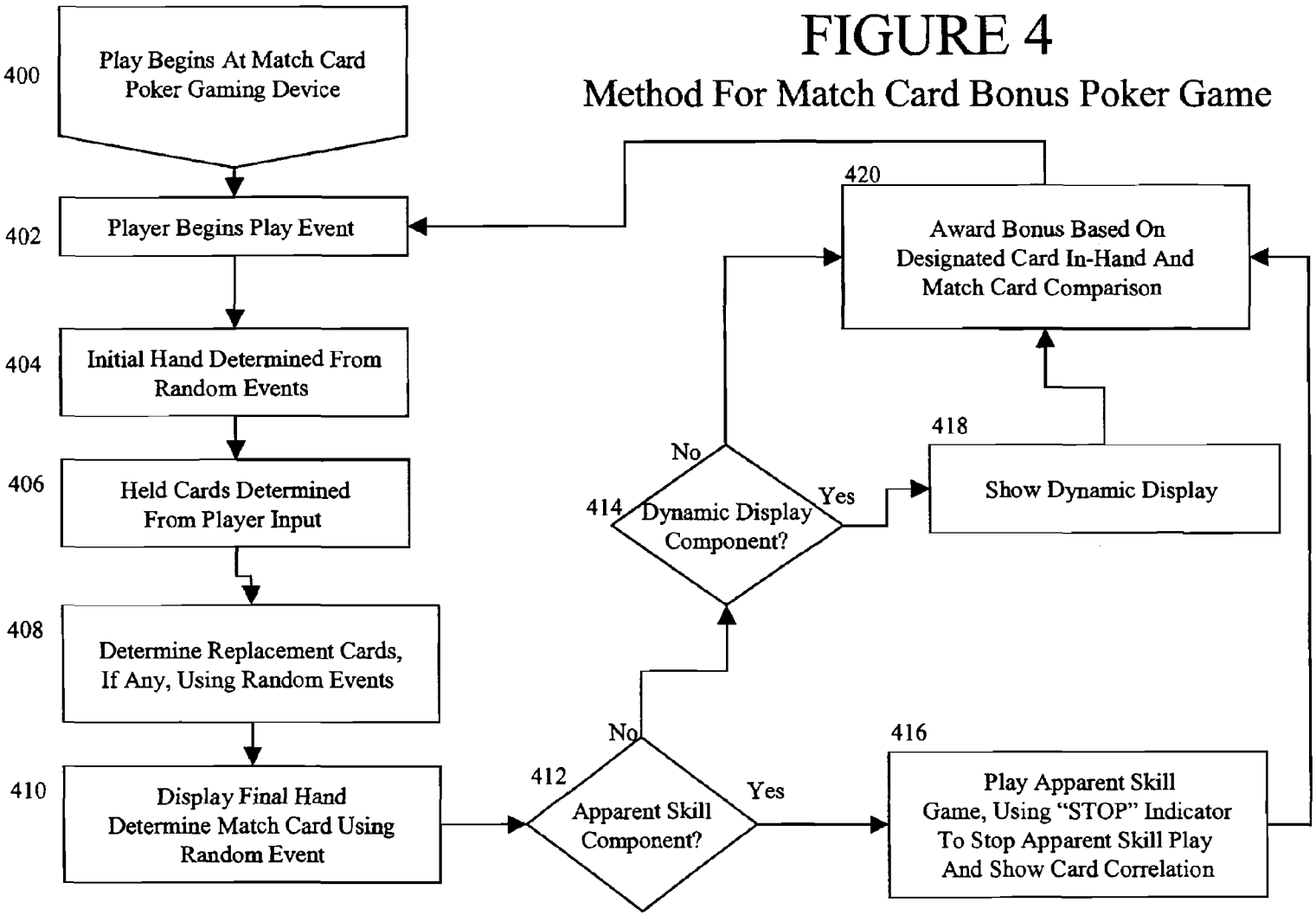
FIG. 4 is a flow diagram illustrating game play in accordance with the present invention.

Referring now to FIG. 4, a player begins play at a game device having match card poker, box 400. The player initiates a game play event, box 402. A game play event is any action or actions (such as choosing bet amounts and then hitting a "play" button) by a player that results in game play be started. Upon the occurrence of a game initiation event, box 402 is left and box 404 entered.

The actions corresponding to box 404 are a sequence of random events (based on the numbers generated by a random number generator) that determine an initial poker hand, and the initial poker hand being displayed on the gaming machine in a manner visible to a player. Box 404 is left and box 406 entered.

The actions associated with box 406 are to determine which (if any) cards have been designated as "hold" by a player. Those cards will not be replaced. The player will indicate their choice using whatever means the game machine has implemented; typically either buttons under the cards or touchscreen areas corresponding to each card. Box 406 is left and box 408 entered, where the random determination of needed replacement cards (constrained to be from a normal 52 card deck) is made. Box 410 is the entered, where the final hand is displayed to a player. Further, a random event is used to generate a match card. Box 410 is left and decision diamond 412 entered.

The actions corresponding to diamond 412 are to determine if the present game implementation has an apparent skill component (alternatively, if a player indicates they want to make use of the apparent skill component when given a choice). If there is no apparent skill component, the "No" exit is taken to decision diamond 414. If the game being played does not have a dynamic display component (i.e., the moving match card of FIG. 2, dynamic links as shown in FIG. 3, or any other visually dynamic method of associating cards) the "No' exit is taken to box 420.

The actions corresponding to box 420 are to show the match card, determine if the card from the player's hand that is associated with the match card are a bonus-winning pair, and award any winnings to the player if they are. Box 420 is then left for box 402, where a play session starts again.

Returning to diamond 412, if there is an apparent skill component the "Yes" exist is taken to box 416. The actions corresponding to box 416 are to start the apparent skill display, and stop the movement of the display reasonably soon after the player hits a stop button. Note that there may be several internal logical paths taken by the gaming machine, depending on the game implementation. In one preferred embodiment, the stop (which card is visually linked to the match card) is a further randomly determined event; the game will stop apparent movement by linking the randomly determined pair. In another preferred embodiment, after randomly picking a match card, the game machine will determine if it matches one or more of the cards from the players final hand, and will pick the highest payback to the player (i.e., if the match card is a 4H and the player has a 4D and a I OH in their hand, the highest paying match in one embodiment is the 4D). In this case, the game will show the selected card as the matching card. In other embodiment, the game machine uses the random event generator to generate a bonus win (including zero wins), rather than a card. The game machine then determines what match card linked to what card in a player's hand is needed. This is called reverse mapping, and is shown in more detail in FIG. 5, Other embodiments of determining and displaying match card results with apparent skill will come to the mind of person skilled in this art who also has the benefit of the present disclosure.

Box 416 is left and box 420 entered, taking the actions and path previously described for this box. Finally, if the "Yes" exit is taken from decision diamond 414, then box 418 is entered. The actions corresponding to box 418 are to show a dynamic display to the player, but without any apparent skill component (unlike box 416). In the case of FIG. 2, the match card would be shown traveling back and forth for a few seconds, coming to a stop above one of the player's five cards in an apparently random manner. Similar displays would be used with dynamic links, colors, etc. Box 418 is then left for box 420, corresponding to actions described above.

Figure 5:
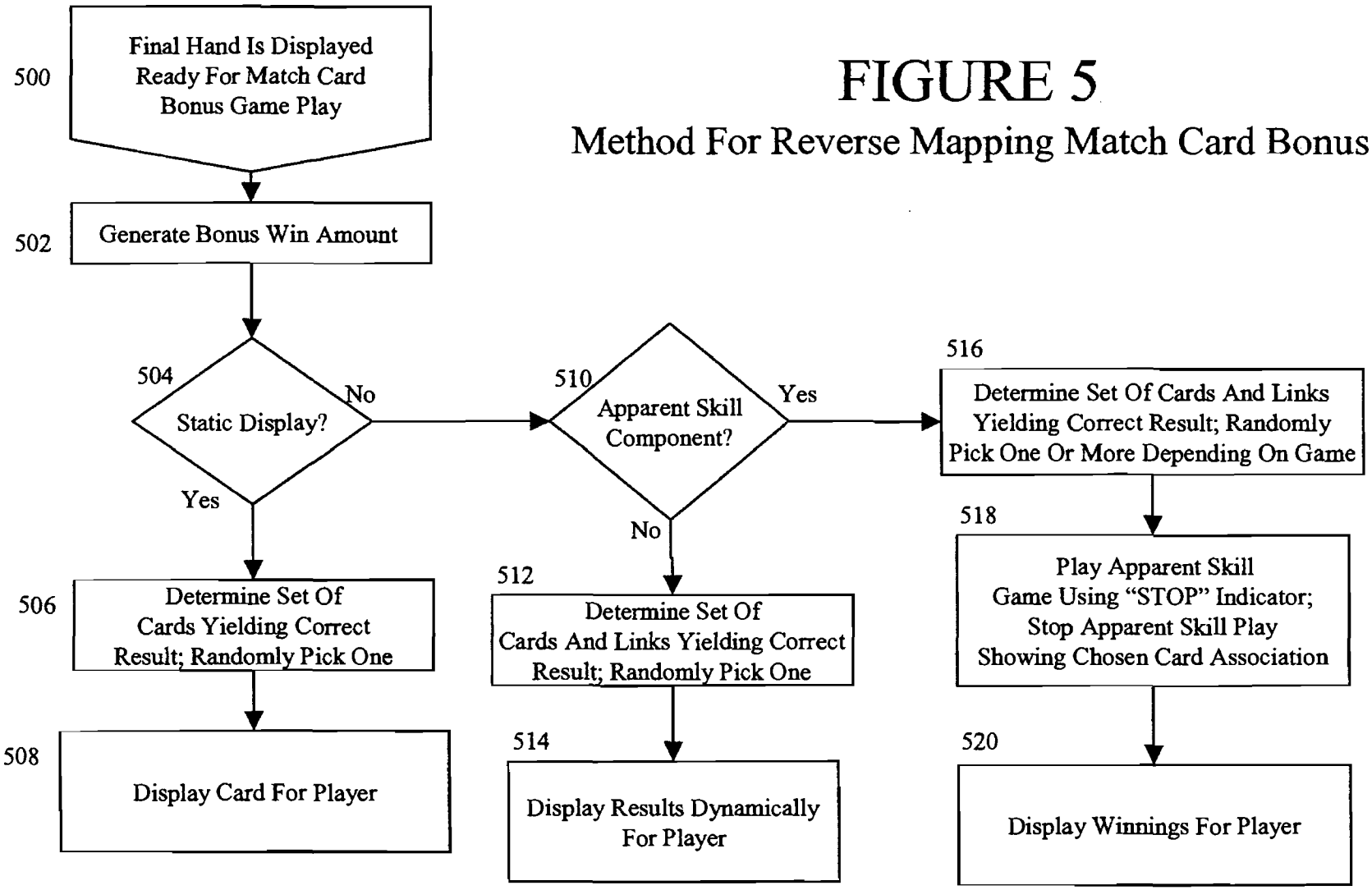
FIG. 5 is a flow diagram illustrating reverse mapping of bonus amount into the match card bonus of the present invention.

FIG. 5 illustrates the use of reverse mapping with match card poker. The difference between a reverse-mapped bonus game and a traditional or Nevada-style bonus game is that the bonus amount is determined first, with the display then structured to represent the predetermined winning amount. In a traditional game, random events are used to create a display result (i.e., the match card and the link), with any winnings then calculated from the randomly determined display elements.

Box 500 represents a game play that is at the end of the regular (non-bonus) portion. This would correspond to box 410 in FIG. 4. The game is now ready to enter the bonus portion of play. Note: there may be triggers or thresholds required to enter the bonus round, such as at least two pair in the final hand. Any such minimal or bonus-entry triggers or threshold may be used by either the game developers using the present invention, or by the casinos using games having the present invention. All such variations are within the scope of the present invention.

Continuing with box 502, either game itself or the game controller to which the present game machine is connected (using the network connection shown in FIGS. 1-3) determines a bonus amount. Box 502 is left for decision diamond 504. If the game machine has a static display (no dynamic ability to link a match card with one of the player's final cards—the relationship is fixed, as shown in FIG. 1), the answer is "Yes" and the "Yes" exit is taken to box 506. The game machine uses the predetermined bonus amount (which includes a possible 0 or no-win) and the player's card which will be linked or paired with the match card, and determines which possible match cards will create the needed bonus amount. Note that for lower win amounts, it may be possible that a set of cards would create the needed results (i.e., if it correlated with a matched suit but not a matching value). Once the set is determined, the game will use a random event to pick one of the set (this keeps regular players from noticing a pattern). If the bonus amount requires a specific match card (i.e., same suit and value), that card will be used. Box 506 is left and box 508 entered.

The actions corresponding to box 508 are to display the match card and award the player the predetermined bonus amount (or prize, if it is a tangible prize machine).

Returning to diamond 504, if the display is dynamic the "No" exit is taken to diamond 510. The path taken from diamond 510 is determined by the existence of apparent skill. If there is not an apparent skill element to the game (as described above), the "No" exit is taken to box 512.

The action corresponding to box 512 are very similar to those in 506, with additions. Since the display is dynamic, there will be more choices to ways to create the bonus amount, since the game can use any card from the final hand of the player instead of just one. The game generates each possible combination (alternatively, a subset of possible combinations if the game designer so desires for bonus amounts that result in large solution-spaces), then picks one. In a preferred embodiment, the choice will be randomized. Once the choice is made, box 512 is left and box 514 entered.

The actions corresponding to box 514 are to use the dynamic display to show multiple possible pairings (dynamic links, moving match card, lighting, or any other way of indicating pairs). The display will stop at the predetermined pairing after a suitably entertaining amount of time.

Returning to diamond 510, if there is an apparent skill element to the game, the "Yes" exit is taken to box 516. The action taken in box 516 are similar to those taken in box 512, with the addition that it is not necessarily the case that a single solution (pairing) must be made at this time. If there are a plurality of parings, the game designers can chose to pick one or pick a set to be used by the logic that will respond to the player's "stop" input. This will be partially determined by the processing bandwidth of the game platform and the type of dynamic display being used. For example, if the dynamic display is a sequential display (highlighting possible cards from the players hand in sequence), then the preferred embodiment will be to keep a plurality of pairs/link-positions, and when the player hits the stop indicator, the closest useable pairing will be used where "closest" means the next possible card from the player's hand continuing in a forward sequence. Alternatively, if the links are show in a more random fashion (i.e., using lit borders where the borders are lit in a random fashion) it is possible to use a single predetermined choice and look visually consistent to the player. The chosen pair will be indicated as the next illustrated pair after the player uses a stop indicator.

Continuing on with box 520, after the player uses a stop indicator the final display is shown correlating with the predetermined win amount. The player is then credited with the winnings, given a prize, given a prize redemption voucher, or whatever other form of prize, award, or winnings as are in use in the casino where the game is used.

As used in this disclosure, "player interactions" or "player interaction" includes any and all player use of the game that are in accordance with the general type of poker being simulated coupled with the rules of the particular implementation. In one preferred embodiment, there is a five card hand shown to the player, and the player interaction consists of choosing which cards to hold, with any cards not held being replaced with new cards. In this preferred embodiment the player may hold from 0 to 5 cards. The player may change their mind as much as they prefer until the player indicates to the game device the player is ready for the replacement cards. This is usually accomplished by touching a "deal" or "play" button. Once the play button is touched, the game device no longer accepts player input for card choice, and the play sequence finishes.

The word "winnings" is used in this disclosure to mean any form or type of winnable item found on any type of game device. This may be game credits, award credits, savable game states corresponding to some form of value associated with game play, cash, vouchers, tickets, tokens, fixed-value prizes, and any other form of winnable unit that may be used in a game device. A "winning amount" or "winnings amount" is used to mean some number of the winnable units.

The present invention has been partially described using a flow diagram. As will be understood by a person of ordinary skill in the art and with the benefit of the present disclosure, steps described in the flow diagram can vary as to order, content, allocation of resources between steps, times repeated, and similar variations while staying fully within the inventive concepts disclosed herein.

Accordingly, it will be seen that this invention provides a system and method for providing a bonus game using a matching card, drawn as a separate random event than the main game. Further included is an active display and the capability to have apparent skill. This is accomplished with the use of a special card called a match card in association with a card in the player's hand, where the association may be made using a visible link which can be made to appear dynamic (moving). Although the description above contains certain specificity, the described embodiments should not be construed indicating the scope of the invention; the descriptions given are merely providing an illustration of embodiments of the invention. The scope of this invention is determined by the appended claims and their legal equivalents.

What is claimed:

1. A method for providing an enhanced player experience on a video poker game device configured to play at least one game of poker whose outcome is based at least partially on a random event, the method comprising:

displaying an initial set of cards comprising an initial hand in accordance with the at least one game of poker on a video display on the video poker game device;

allowing player interactions with the game device via game buttons where the player interactions are in accordance with the at least one game of poker;

determining and displaying a final set of cards and an associated win value, if any, on the video display by generating replacement cards for any cards indicated as replaceable in accordance with the at least one game of poker and the player interactions;

generating and displaying on the video display a next single card after the win value, if any, is determined;

associating the next single card with one card from the final set of cards on the video display, wherein the next single card apparently moves on the video screen in a manner visible to the player and the next single card stops in a manner that visually associates the next single card with one card of the final set of cards; and, awarding a bonus amount based on the associated cards where the bonus amount is not primarily based on a poker value of the final set of cards in combination with the next single card, and where eligibility to the bonus is not based on a wager specific to the bonus.

2. The method of claim 1, wherein associating the next single card with one card from the final set of cards further comprises allowing the player to interactively enter a stop request after the next single card is apparently moving and before the match card stops apparent movement, and wherein the apparently moving next single card further stops apparent movement after the game device receives a stop request, and in a manner visually associating the next single card with one of the final set of cards.

3. The method of claim 1, wherein associating the next single card with one card from the final set of cards further comprises having a moveable element on a screen visible to a player having a first end and a second end connected by a visible connector portion, wherein the first end is in visual association with the next single card and the second end and the connector portion move on the screen and then stop moving such that the second end is in visible association with the one card from the final set of cards.

4. A method for generating a bonus while playing poker on a gaming machine, the method comprising:

providing at least one poker game on the gaming machine, wherein results of the poker game are at least partially determined by a random event;

starting the game of poker in response to player input received from a play button on the gaming machine;

obtaining and presenting a video display of the gaming machine a final set of cards with a win value, if any, for the game of poker;

generating a match card using a random event after the final set of cards is reached;

associating the match card with one card from the final set of cards, wherein the match card moves on the video screen in a manner visible to a player and stops in a manner that visually associates the match card with one card from the final set of cards; and, determining a bonus amount using the two associated cards, wherein the bonus amount is not primarily based on a poker value of the final set of cards in combination with the next single card, and wherein eligibility to the bonus is not based on a wager specific to the bonus.

5. The method of claim 4, wherein associating the match card with the one final set card further comprises allowing the player to interactively enter a stop request after the match card is moving, and wherein the moving match card further stops moving as quickly as possible after the game device receives an stop request and in a manner visually associated the match card with the one final set card.

6. The method of claim 4, wherein associating the match card with the one final set card further comprises having a moveable element on a screen visible to the player having a first end and a second end connected by a visible connector portion, wherein the first end is in visual association with the match card, and wherein the second end and the connector portion show apparent movement to the player and then stop moving such that the second end is in visible association with the one final set card.

7. The method of claim 6, wherein associating the match card with the one final set card further comprises allowing the player to interactively enter a stop request after the second end is moving, and wherein the second end stops moving after the game device receives an stop request in a manner visually associating the second end with the one final set card.

8. A method for generating a bonus while playing poker on a gaming machine, the method comprising:

providing at least one poker game on the gaming machine, wherein results of the poker game are at least partially determined by a random event;

starting the game of poker in response to player input received from a play button on the gaming machine;

obtaining and presenting a video display of the gaming machine a final set of cards with a win value, if any, for the game of poker;

generating a bonus;

generating a match card after the final set of cards is reached, wherein the match card is associable with one of the final set of cards to indicate the bonus to a player, wherein the bonus amount is not primarily based on a poker value of the final set of cards in combination with the next single card, and wherein eligibility to the bonus is not based on a wager specific to the bonus;

presenting the match card with the one final set of cards on the video display, wherein the match card moves relative tot the final set of cards; and receiving a stop request after the match card is moving on the video display, wherein the moving match card further stops moving after the game device receives the stop request and in a manner that visually associates the match card and one final set card in a manner correctly indicating the bonus.

9. The method of claim 8, further comprising associating the match card with one card from the final set of cards using a moveable element on a screen visible to the player having a first end and a second end connected by a visible connector portion, wherein the first end is in visual association with the match card and where the second end and the connector portion show apparent movement to the player and stop moving such that the second end visually associates the match card and one final set card in a manner correctly indicating the bonus.

10. The method of claim 8, wherein associating the match card with the one final set card further comprises allowing the player to interactively enter a stop request after the second end is moving, and wherein the second end stops moving after the game device receives an stop request in a manner that visually associates the match card and one final set card in a manner correctly indicating the bonus.

* * * * *

UNITED STATES PATENT AND TRADEMARK OFFICE

CERTIFICATE OF CORRECTION

PATENT NO. : 7,874,903 B2
APPLICATION NO. : 11/550349
DATED : January 25, 2011
INVENTOR(S) : Warren R. White et al.

It is certified that error appears in the above-identified patent and that said Letters Patent is hereby corrected as shown below:

Column 1
In line 37, replace “form” with --forms--
In line 65, delete “is” after --This--

Column 2
In line 2, replace “by” with --buy--
In line 14, replace “represents” with --presents--
In line 15, delete “as” after --in--
In line 20, delete “a” after --with-- and before --5--
In line 27, insert --each-- after --from--
In line 33, replace “produced” with --produce--
In line 37, replace “tradition” with --traditional--

Column 4
In line 30, replace “diamond” with --diamonds--

Column 5
In line 38, replace “them” with --then--

Signed and Sealed this
Twelfth Day of April, 2011

David J. Kappos

David J. Kappos
*Director of the United States Patent and Trademark Office*